US005813209A

United States Patent [19]

Hirao et al.

[11] Patent Number: 5,813,209

[45] Date of Patent: Sep. 29, 1998

[54] PIECING METHOD AND DEVICE FOR A SPINNING MACHINE

[75] Inventors: Osamu Hirao, Uji; Masahiko Nishimura, Kyoto, both of Japan

[73] Assignee: Murata Kikai Kabushiki Kaisha, Kyoto, Japan

[21] Appl. No.: 856,537

[22] Filed: May 14, 1997

[30] Foreign Application Priority Data

May 16, 1996 [JP] Japan ..... 8-146632

[51] Int. Cl.[6] ..... D01H 11/00

[52] U.S. Cl. ..... 57/261; 57/22; 57/279; 57/328; 57/333

[58] Field of Search ..... 57/22, 261, 279, 57/328, 333

[56] References Cited

U.S. PATENT DOCUMENTS 5,511,373 4/1996 Banba ..... 57/333
5,673,547 10/1997 Baba et al. ..... 57/333

FOREIGN PATENT DOCUMENTS 6-173129 6/1994 Japan .
6-173132 6/1994 Japan ..... 57/261
6-220728 8/1994 Japan ..... 57/261
6-220729 8/1994 Japan ..... 57/261
8-120532 5/1996 Japan .

*Primary Examiner*—William Stryjewski
*Attorney, Agent, or Firm*—Armstrong, Westerman, Hattori, McLeland, & Naughton

[57] ABSTRACT

Piecing method of a spinning machine whereby, after holding outside a twist device both a leading yarn ejected from the sliver guide entrance of a twist device in a stationary state and a sliver delivered by a re-operated draft device, the twist device is operated, the sliver supplied to the twist device and the fibers comprising the sliver are entangled in the leading yarn pulled from the twist device. The success rate of yarn piecing may be improved without detailed adjustment of the pulling timing of the leading yarn guided into the twist device and the supply timing of the sliver supplied to the twist device.

6 Claims, 7 Drawing Sheets

PIECING METHOD AND DEVICE FOR A SPINNING MACHINE

FIELD OF THE INVENTION

The present invention relates to a piecing method for joining several yarn and a device for performing such method on a spinning machine.

BACKGROUND OF THE INVENTION

A piecing method and a device for such has been developed whereby the winding side yarn end is guided into a twist device of a spinning machine and thereafter, the end of the sliver guided into the twist device and the yarn end of the yarn of the winding side (being the yarn drawn from the yarn package and below, known simply as "leading yarn") guided into the twist device are joined by a spinning process due to the restarting of spinning.

In the above described piecing method of a spinning device, the timing of pulling the leading yarn guided into the twist device and the supply timing of the sliver supplied into the spinning nozzle by the restarting of the backrollers are extremely important for improving the success rate of yarn piecing.

Accordingly, in the above described piecing method, the pull timing of the leading yarn guided into the twist device may become faster than the supply timing of the sliver supplied to the twist device thus meaning the fibers comprising the sliver do not entangle with the leading yarn resulting in a piecing failure, or the entanglement of only a small amount of fibers resulting in a taper shaped sliver tip entangling with the leading yarn forming a thin yarn piecing part and increasing the possibility of re-breakage of the yarn.

SUMMARY OF THE INVENTION

It is an object of the present invention to provide a piecing method for a spinning machine and a device for performing such method which increases the success rate of yarn piecing and improves the yarn pieced part without requiring adjustment of the pull timing of the leading yarn being guided into the twist device and the supply timing of the sliver supplied to the twist device.

In order to achive the above described object, a first aspect of the present invention is a method whereby, after holding outside a twist device both a leading yarn ejected from the sliver guide entrance of a twist device in a stationary state and a sliver delivered by a re-operated draft device, the twist device is operated, the sliver supplied to the twist device and the fibers comprising the sliver are entangled in the leading yarn pulled from the twist device.

A second aspect is the arrangement on the piecing device of a spinning machine of a means for inserting the leading yarn into the twist device in the stationary state and a suction pipe for sucking and holding both the leading yarn ejected from the sliver guide entrance of the twist device in the stationary state and the sliver delivered by the restarted draft device.

A third aspect of the present invention is the formation in the spindle of an air blowing hole for ejecting the leading yarn inserted in the spindle of the stationary twist device from the sliver guide entrance of the twist device.

DETAILED DESCRIPTION OF THE PREFERRED EMBODIMENTS

Hereafter, an embodiment applicable to the present invention will be described using the drawings but the present invention is not limited to that described provided the aims of the invention are not surpassed.

Figure 1:
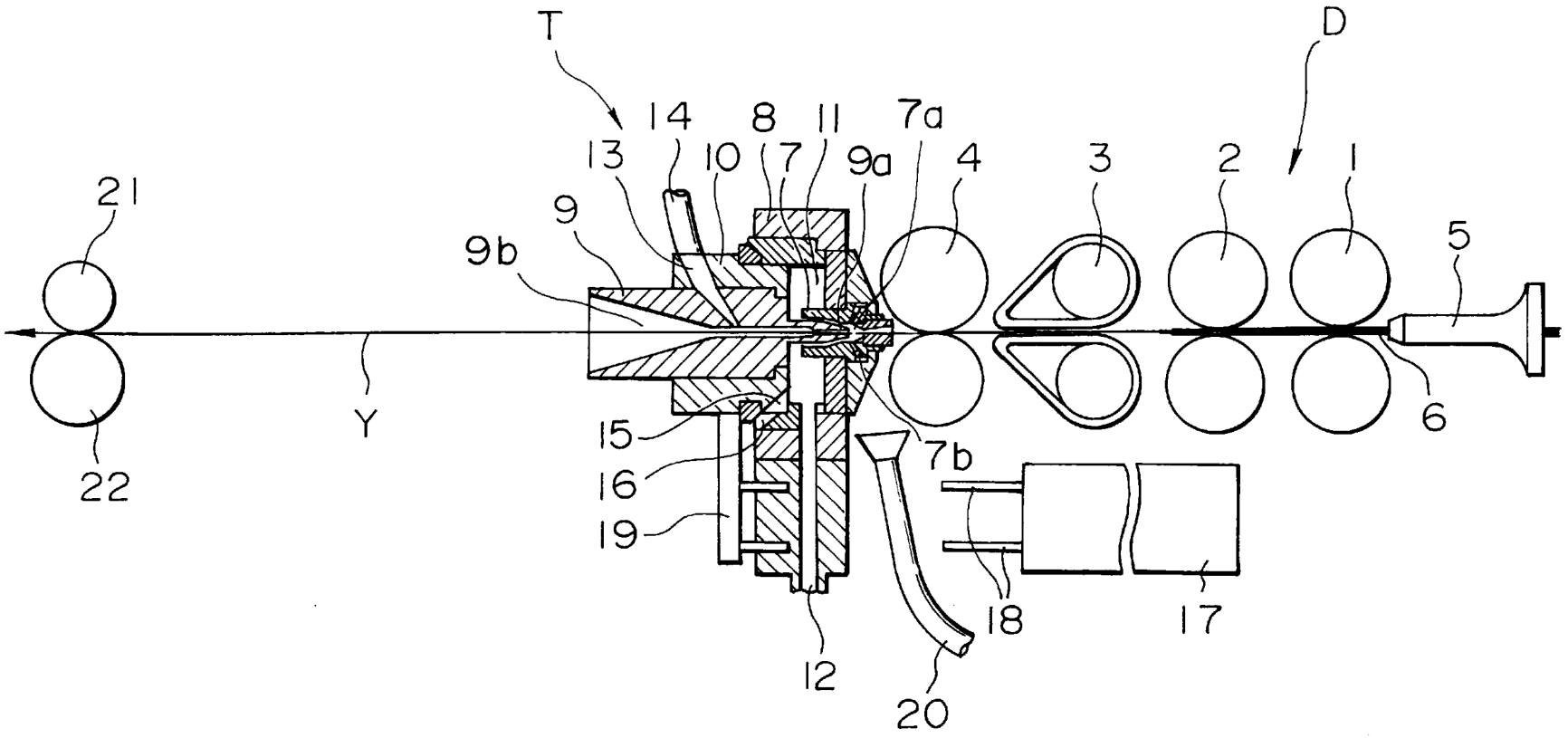
FIG. 1 is a side view including a partial section of the spinning device being one embodiment applicable to the present invention.
Figure 2:
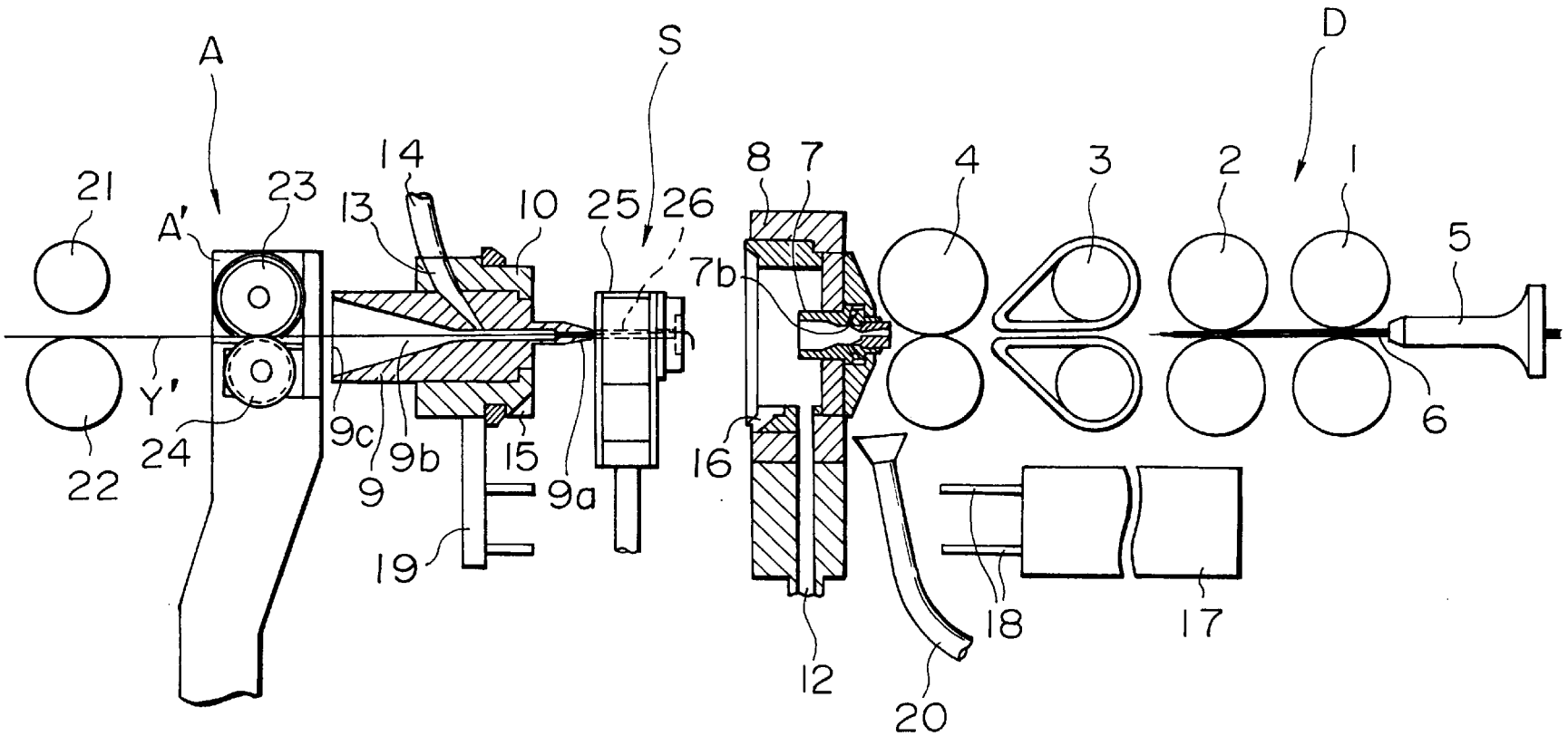
FIG. 2 is similarly a side view including a partial section of the spinning device being one embodiment applicable to the present invention.
Figure 6:
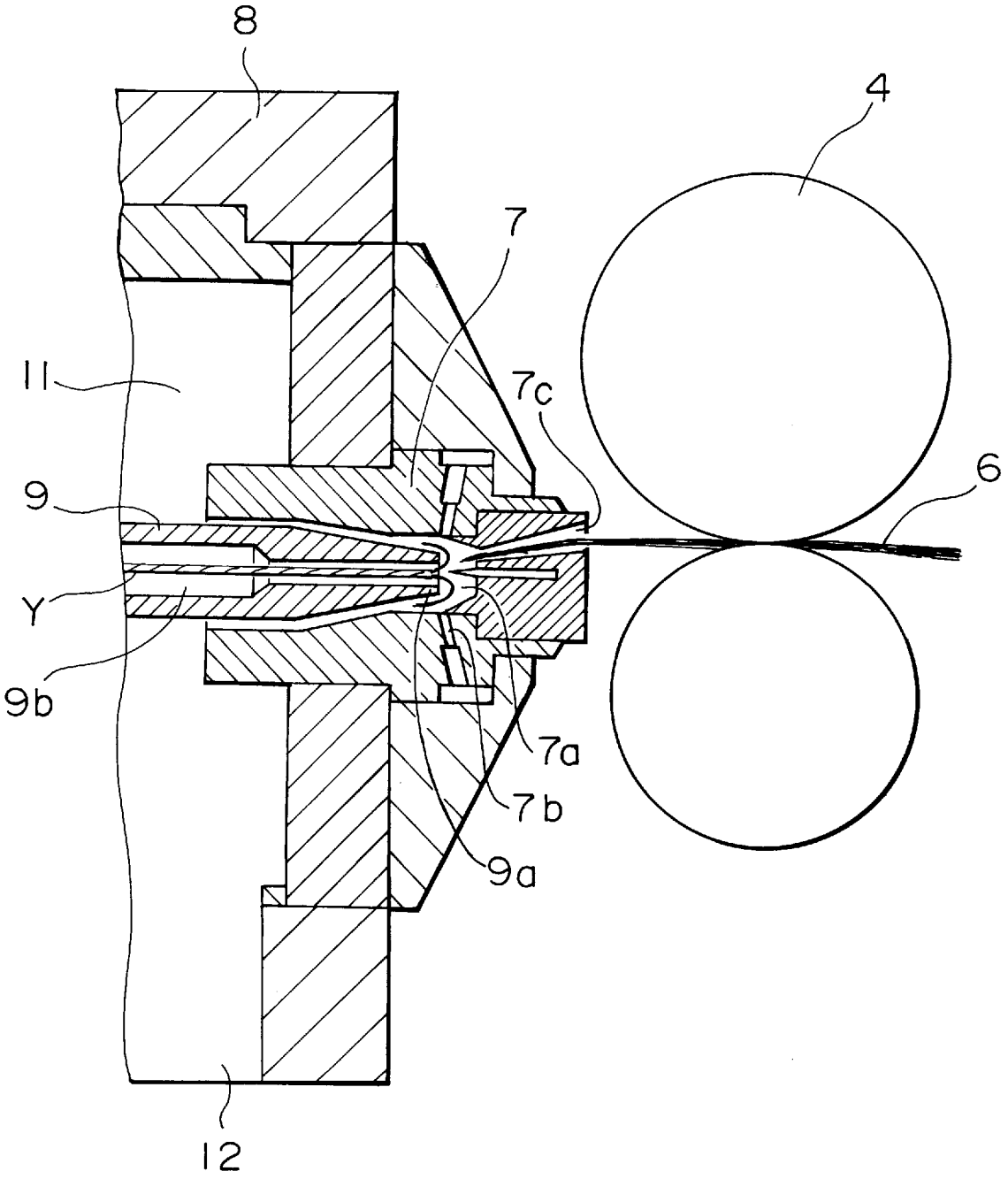
FIG. 6 is a partial of the spinning device of the present invention expanded section of the twist part.
Figure 7:
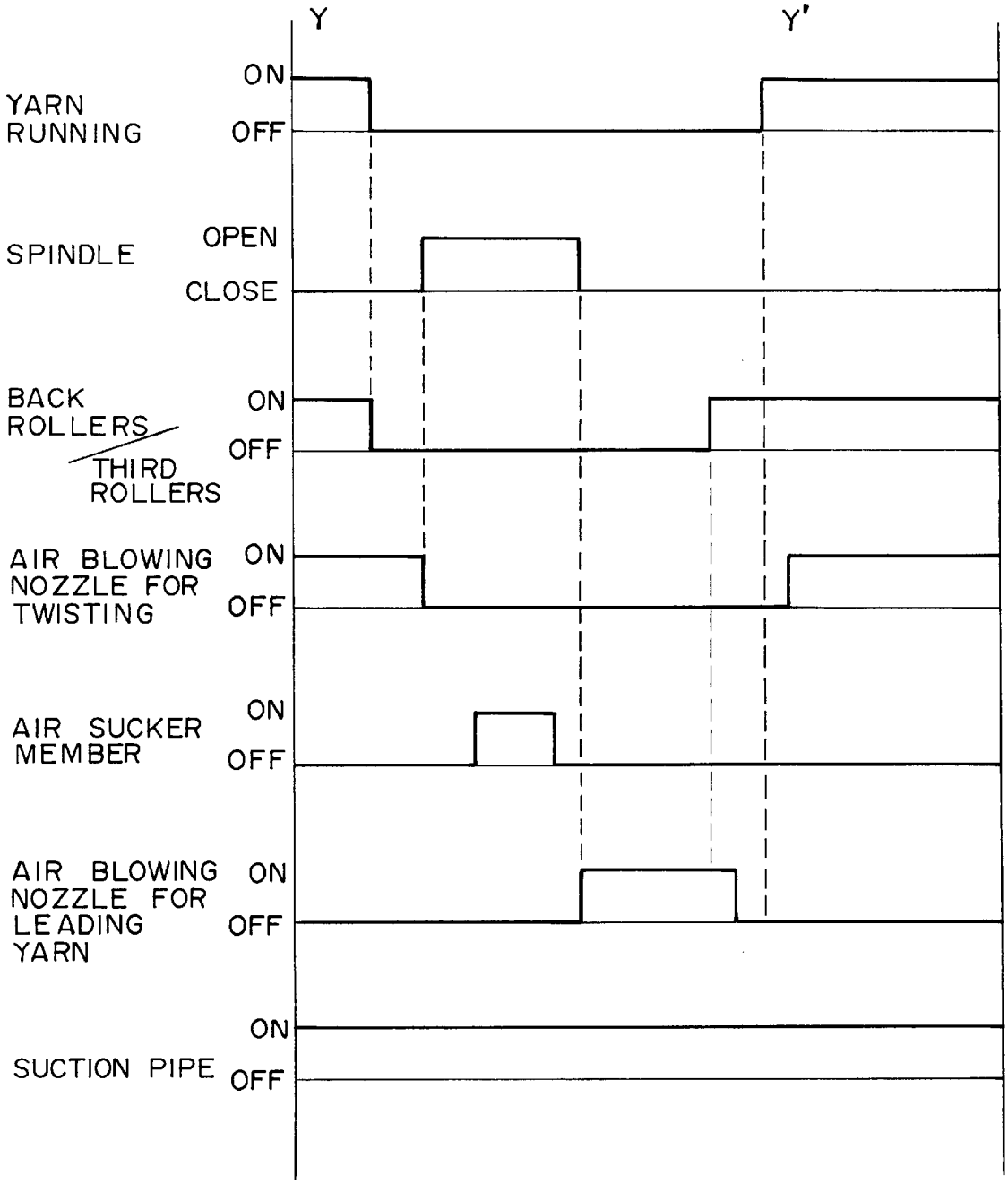
FIG. 7 is a timing chart of the yarn piecing actions of the present invention.

Firstly, a spinning device being one embodiment applicable to the piecing method of the spinning machine will be described using FIGS. 1 and 6.

Letter D is a draft device showing a four line type draft device as an example. The draft device D comprises the four lines including back rollers 1, third rollers 2, middle rollers 3 attached with an apron belt and front rollers 4. Reference numeral 5 is a sliver guide with sliver 6 being inserted into the sliver guide 5 and supplied to the draft device D. The silver 6 is then supplied to a twist device, which will be described later, and produces yarn Y after being supplied to the draft device D and drawn.

A twist device T comprises mainly an air spinning nozzle 7, which produces a spinning air current by the blowing of pressured air, a nozzle block 8 which supports that nozzle 7, a spindle (yarn guide tube) 9 having an insertion hole 9*b* and of which the tip 9*a* is positioned in the inner part 7*a* of the air spinning nozzle 7, and a spindle support member 10 that supports the spindle. The inner part 7*a* of the air spinning nozzle 7 is the piecing area where joining of the fibers comprising the sliver 6 supplied to the inner part 7*a* of the air spinning nozzle 7 and the winding side spun yarn Y Inserted into the insertion hole 9*b* of the spindle 9 and guided into the inner part 7*a* of the air spinning nozzle 7 is carried out.

A plurality of air blowing holes 7*b* for generating a rotating air current are arranged in the air spinning nozzle 7. Reference numeral 11 is an air chamber formed between the nozzle block 8 and spindle support member 10. The air chamber 11 is connected to an air suction source (not shown in the drawings) that sucks air at a low suction pressure via the suction hole 12 and, during spinning, acts as an escape hole for the air blown from the air blowing holes 7*b* of the air spinning nozzle 7 as well as removing fly fiber waste, and the like, generated inside the air chamber 11 during spinning.

Reference numeral 13 is an air blowing hole arranged in the spindle 9 and spindle support member 10 for generating an air current in the direction of the tip 9*a* of the spindle 9. The air blowing hole 13 is connected to a compressed air supply source (not shown in the drawings) via a pipe 14 connected to the spindle support member 10.

Reference numeral 15 is a slit formed in the side wall of the nozzle block 8 side of the spindle support member 10. Reference numeral 16 is a slit formed in the side wall of the spindle support member 10 side nozzle block 8 opposite the slit 15 of the spindle support member 10. As described later, when the nozzle block 8 and spindle support member 10 are coupled together, the leading yarn inserted in the insertion hole 9*b* of the spindle 9 enters the slits 15, 16 and the arrangement is such that it is not trapped by the side wall of nozzle block 8 and the side wall of the spindle support member 10.

Reference numeral 17 is a cylinder. A lower frame 19 of the spindle support member 10 is mounted on the tip of a piston rod 18 of the cylinder 17. Accordingly, the cylinder 17 is moved and the spindle support member 10 is able to couple with, or separate from, the nozzle block 8 by the left and right movements of the lower frame 19.

Reference numeral 20 is a suction pipe of which the tip is positioned between the nozzle block 8 and front roller 4 and connected to a suction air source (not shown in the drawings). Reference numeral 21 is a nip roller being freely connectable/separable to the delivery roller 22, which is normally always driven, and is so arranged that the spun yarn Y is delivered in the direction of the winding machine (not shown in the drawings) by connecting the nip roller 21 with the delivery roller 22.

When the spinning machine is spinning yarn Y, the sliver 6 supplied to the draft device D via the sliver guide 5 is twisted by the twist device T after being drawn by the draft device D and forms a yarn Y. In short, the fibers comprising the sliver 6 supplied to the air spinning nozzle 7 of the twist device T enter the insertion hole 9*b* of the spindle 9 from the tip 9*a* while being rotated by a rotating air current blown from the air blowing holes 7*b* and a yarn Y is produced. In this way, under normal spinning machine operating conditions, supply of the compressed air from the air blowing hole 13 does not occur, the suction pipe 20 operates and accordingly, normally, suction air is generated in the suction pipe 20.

Next, using FIGS. 2 to 7, the piecing process will be described.

When a yarn breakage occurs, a detection signal is generated by a detection sensor (not shown in the drawings) and, in association with that, supply of the sliver 6 is stopped by stoppage of the driving of the back rollers 1 and third rollers 2 via a clutch (not shown in the drawings) connected to the back rollers 1. The twist device T continues operations as before. The tip of the sliver 6 is then immediately pulled into a tapered shape between the stationary third rollers 2 and still driving middle rollers 3. Furthermore, after a predetermined time period has elapsed, the blowing of air from the air blowing holes 7*b* is stopped and the operation of the twist device is thus T stopped.

Next, the piston rod 18 is advanced by movement of the cylinder 17 whereby the spindle support member 10 is separated from the nozzle block 8 and the head A' or transfer arm member A, which grips by a pair of drive rollers 23, 24 the tip or the leading yarn Y' wound onto the winding package, and pulls it from the winding by a publicly known suction mouth. Or the leading yarn Y' may be pulled from a package prepared for other uses, positioned in the vicinity of the yarn exit hole 9*c* of the spindle 9. Coincident therewith, a suction head 25 of an air sucker member S is positioned between the spindle support member 10 and nozzle block 8 such that the tip 9*a* of the spindle 9 is in the vicinity of the suction hole 26 of the suction head 25.

Thereafter, a suction air current is generated in the suction hole 26 of the suction head 25 and the leading yarn Y' is inserted in the Insertion hole 9*b* of the spindle 9 by operation of the drive rollers 23, 24 of the transfer arm member A. Then the tip of the leading yarn Y' is sucked and held in the suction head 25 of the air sucker member S (Refer to FIG. 2).

Figure 3:
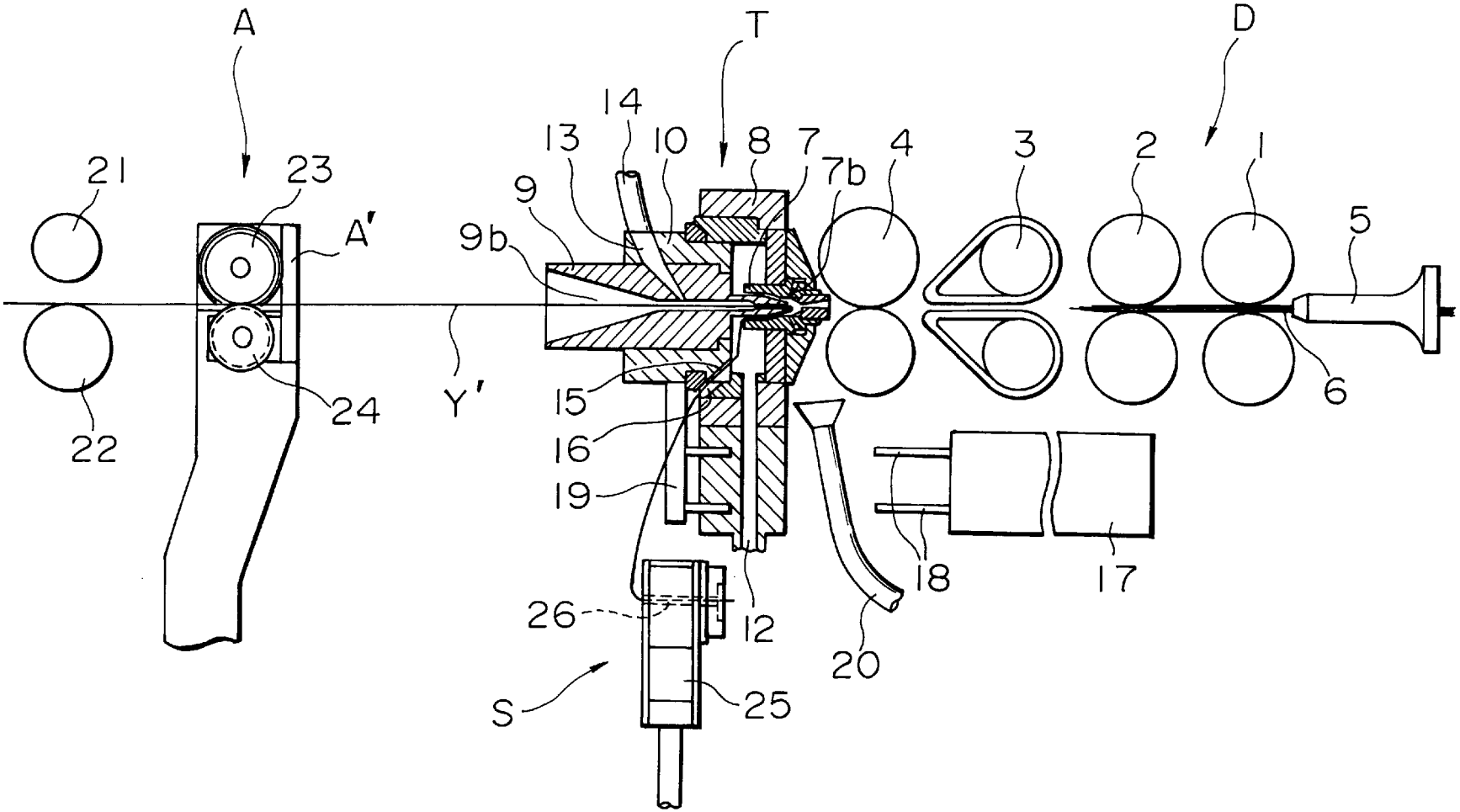
FIG. 3 is similarly a side view including a partial section of the spinning device being one embodiment applicable to the present invention.

Next, as shown in FIG. 3, the air sucker member S which holds the leading yarn Y' is lowered, the piston rod 18 is retracted by operation of the cylinder 17 and the spindle support member 10 and nozzle block 8 are coupled. Even if the spindle support member 10 and nozzle block 8 couple, the leading yarn Y' is not trapped by the walls of the spindle support member 10 and nozzle block 8 as it enters the slits 15, 16. In association with the lowering of the air sucker member S, the drive rollers 23, 24 are stopped after delivery of a predetermined amount of leading yarn Y' by operation of the drive rollers 23, 24 of the transfer arm member A.

Next, an air current in the direction of the tip 9*a* is generated in the insertion hole 9*b* of the spindle 9 by supplying compressed air to the air blowing hole 13 from a compressed air supply source (not shown in the drawings) via a pipe 14. It should be noted that a suction air current is normally generated in the suction pipe 20.

Figure 4:
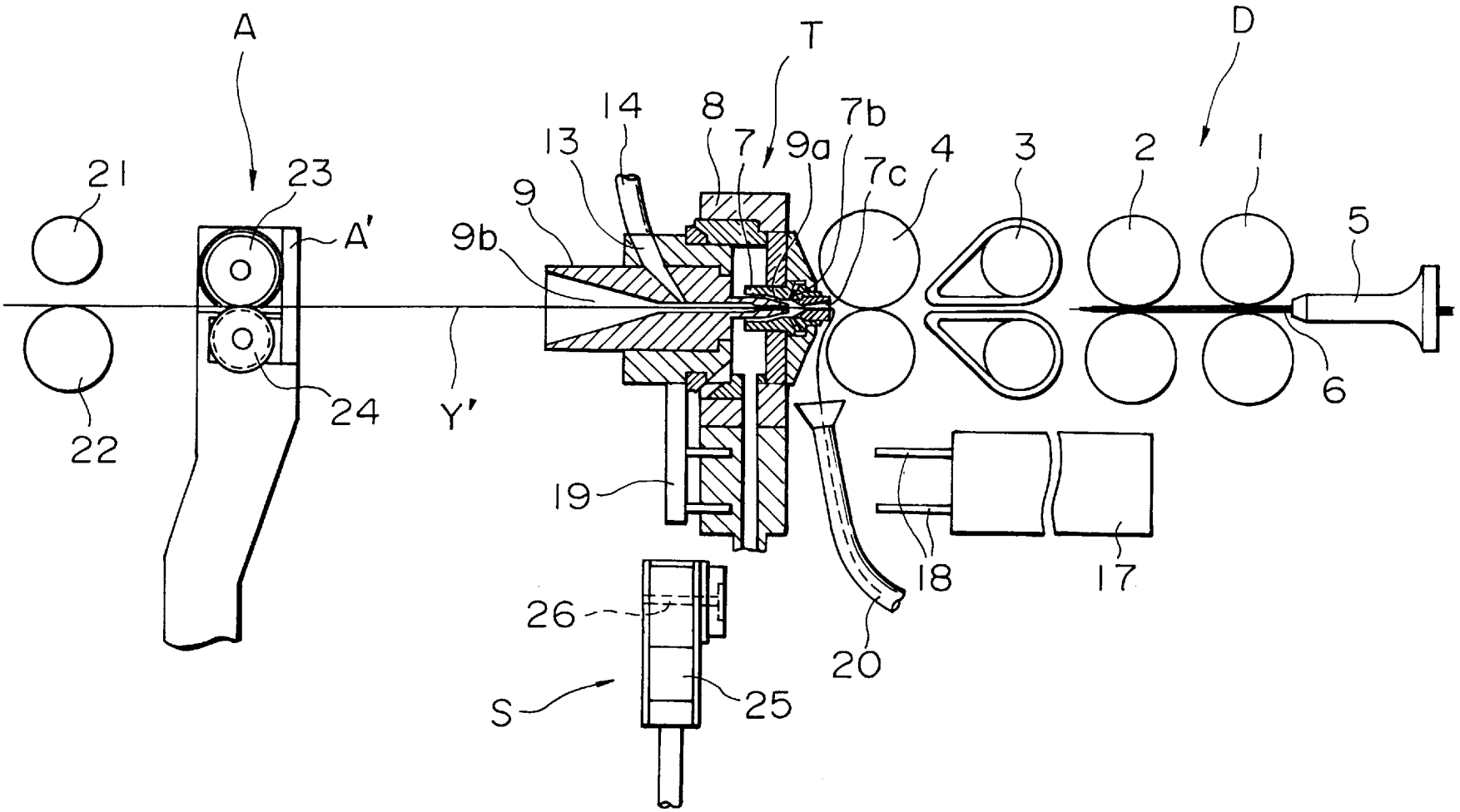
FIG. 4 is similarly a side view including a partial section of the spinning device being one embodiment applicable to the present invention.

When the suction air current generated in the suction pipe 26 of the air sucker member S is stopped, the leading yarn Y' held in the air sucker member S is inserted in the suction pipe 20, in which is generated a suction air current, by ejection from the sliver guide entrance 7*c* of the air spinning nozzle 7, the hole for guidance into the twist device T of the sliver 6, due to the air current generated in the insertion hole 9*b* of the spindle 9 in the direction of the tip 9*a* (Refer to FIG. 4).

After the leading yarn Y' has been inserted in the insertion hole 9*b* of the spindle 9 and held in the suction pipe 20, it, is preferable for the supply of compressed air to the air blowing hole 13 to stop but when the compressed air blown from the air blowing holes 7*b* of the air spinning nozzle 7 is strong enough, even if compressed air is blown from the air blowing hole 13, there is no influence on the driving of the twist device T and the supply of compressed air to the air blowing hole 13 need not be stopped.

It should be noted that, in this state as shown in FIG. 4, it is preferable for the leading yarn Y' to be gripped by the stationary drive roller 23, 24 of the transfer arm member A so that surplus leading yarn Y' is not fed out. However, the transfer arm member A may also be returned to a standby position by releasing the holding of the leading yarn Y' by the drive rollers 23, 24 of the transfer arm member A.

It should be noted that the transfer arm member A and air sucker member S has been previously disclosed by the present applicant in the Japanese Patent Application No. Hei 4-325021 (Patent Laid Open No. Hei 6-173129) and the Japanese Patent Application No. Hei 6-284269, therefore the specific details of such have been omitted, but if a predetermined amount of leading yarn Y' may be fed out, it is not limited to the above mentioned transfer arm member A and if generation of a suction air current is possible, is not limited to the above mentioned air sucker member S.

Figure 5:
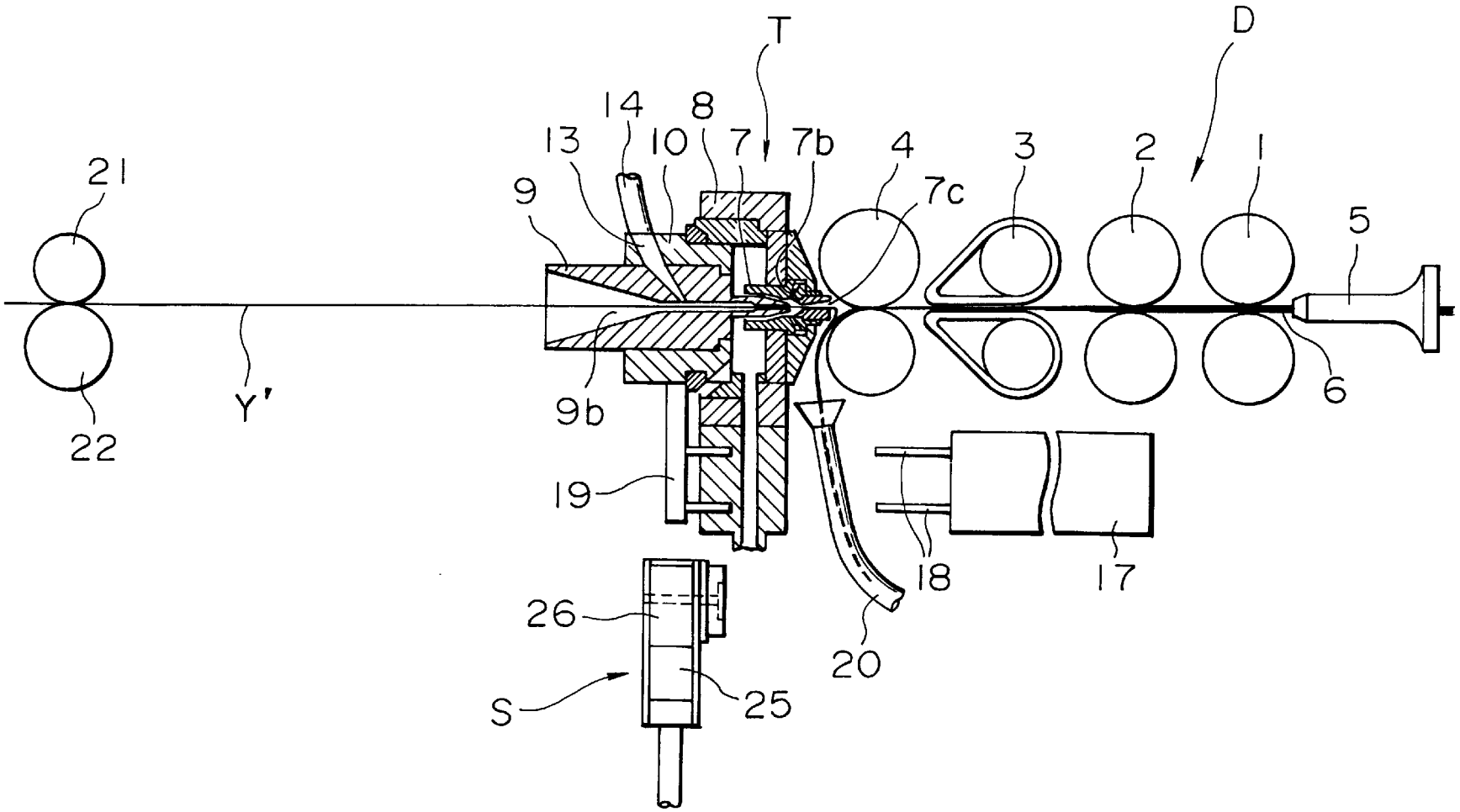
FIG. 5 is similarly a side view including a partial section of the spinning device being one embodiment applicable to the present invention.

Next, while the operation of the twist device T is stopped, in short, while the blowing of air from the air blowing holes 7*b* is stopped, the stationary back rollers 1 and third rollers 2 restart and when the sliver 6 gripped by the back rollers 1 and third rollers 2 moves, the sliver 6 fed out from the front rollers 4 is inserted in the suction pipe 20. In short, as shown in FIG. 5, the leading yarn Y' ejected from the sliver guide entrance 7*c* of the air spinning nozzle 7 and the sliver 6 fed out from the front rollers 4 are inserted in the suction pipe 20 together. The sliver 6 is able to be sucked into the suction pipe 20 by the continued driving of the draft device D.

As described above, when the leading yarn Y' and sliver 6 drawn by the restarting of the draft device D are sucked together into the suction pipe 20, the leading yarn Y' is pulled in the direction of the winding package by the contact of the nip rollers 21 with the delivery rollers 22 and when air is blown from the air blowing holes 7*b*, a suction air current stronger than the suction air current of the suction pipe 20 is generated in the vicinity of the sliver guide entrance 7*c* of the air spinning nozzle 7 so fibers comprising the sliver 6 delivered from the front rollers 4 are guided into the sliver guide entrance 7*c* of the air spinning nozzle 7 and yarn piecing is performed by entangling with the leading yarn Y' in the internal part 7*a* of the air spinning nozzle 7 forming the piecing area.

As described above, when the leading yarn Y' and sliver 6 drawn by the restarting of the draft device D are sucked together into the suction pipe 20, as the twist device T restarts, yarn piecing may be reliably performed without reliance on the pulling timing of the leading yarn Y' guided into the twist device T and the supply timing of the sliver 6 to the twist device T by the restarting of the back rollers 1 and third rollers 2.

In the above described embodiment, the spindle support member 10 and nozzle block 8 are comprised so as to be separable and contactable but the spindle support member 10 comprising the twist device T and nozzle block 8 may be a single unit. In that case, after the positioning close to the yarn exit hole 9*c* of the spindle 9, of the head A' of the transfer arm member A which grips the leading yarn Y', an air current in the direction of the tip 9*a* is generated in the insertion hole 9*b* of the spindle 9 by the supply of compressed air to the air blowing hole 13, a suction air current is also generated in the suction pipe 20, the leading yarn Y' is inserted in the twist device T by the operation of the drive rollers 23,24 of the transfer arm member A and ejected from the sliver guide entrance 7*c* of the twist device T. Accordingly, in the present embodiment, the air sucker member S may be ommitted.

Due to the construction as described above, the present invention demonstrates the following advantages:

The success rate of yarn piecing may be increased without the need for detailed adjustment of the pulling timing of the leading yarn guided to the twist device and the supply timing of the sliver supplied to the twist device.

As a control means for detailed adjustment of the pulling timing of the leading yarn guided to the twist device and the supply timing of the sliver supplied to the twist device may be ommitted, the piecing device may be simplified.

We claim:

1. A piecing method for piecing yarn to sliver in a spinning machine having a draft device for supplying sliver, a twist device including a spinning nozzle with a sliver guide entrance to receive sliver from said draft device and a spindle for twisting sliver into yarn, and a winding package for winding yarn produced by said twisting device, comprising the steps of:

withdrawing a predetermined length of yarn from said winding package for delivering it through said twist device to a holding region intermediate said twist device and said draft device;

blowing air through said spindle in the direction of said spinning nozzle to urge said yarn through said sliver guide entrance to said holding region between said twist device and said draft device;

supplying sliver by said draft device to said holding region for entangling with said yarn;

operating said twist device and said winding package to entangle said sliver with said yarn while pulling them through said sliver guide entrance of said spinning nozzle toward said winding package and thereby effect piecing of said sliver with said yarn.

2. The piecing method according to claim 1 including the step of applying a suction force in said holding region for holding said yarn and said sliver when operation of said twisting device is commenced.

3. The piecing method according to claim 1 including the steps of:

separating said spinning nozzle from said spindle prior to withdrawing yarn from said winding package, and recoupling said spinning nozzle and said spindle prior to blowing air through said spindle to urge said yarn to said holding region.

4. Apparatus for piecing separated yarn from sliver in a spinning machine having a draft device for supplying sliver, a twist device including a spinning nozzle having a sliver guide entrance for delivering sliver to said spinning nozzle and twist air blow holes for applying twisting forces in said spinning nozzle, a spindle separably coupled to said spinning nozzle, a winding package for receiving yarn wound in said twist device, and means for piecing yarn detached from said sliver, said means comprising:

means for withdrawing a predetermined amount of wound yarn from said winding package;

means for moving said yarn through said twist device to a holding region intermediate said twist device and said draft device;

means in said holding region for holding yarn moved through said twist device and sliver supplied by said draft device while applying twisting forces to said yarn in said twisting device to entangle and thereby piece said sliver and said yarn; and means for operating said winding package for winding said pieced yarn.

5. Apparatus according to claim 4 wherein said means for holding comprise a suction pipe disposed in said holding region operative to hold both the yarn from said twist device and sliver from said draft device.

6. Apparatus according to claim 4 including means in said spindle for blowing air in the direction of an entrance of said twist device for moving said yam through said twist device to said holding region.

* * * * *